US011439223B2

(12) United States Patent
D'Alessandro

(10) Patent No.: US 11,439,223 B2
(45) **Date of Patent: *Sep. 13, 2022**

(54) VETERAN SUPPORT BACKPACK

(71) Applicant: Backpacks for Life, Inc., Jersey City, NJ (US)

(72) Inventor: Brett D'Alessandro, Verona, NJ (US)

(73) Assignee: BACKPACKS FOR LIFE, INC., Jersey City, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/192,482

(22) Filed: Mar. 4, 2021

(65) Prior Publication Data

US 2021/0186186 A1 Jun. 24, 2021

Related U.S. Application Data

(63) Continuation of application No. 16/670,198, filed on Oct. 31, 2019, now Pat. No. 10,952,522.

(60) Provisional application No. 62/753,669, filed on Oct. 31, 2018.

(51) Int. Cl.

| | |
|---|---|
| ***A45F 3/04*** | (2006.01) |
| ***A45F 3/06*** | (2006.01) |
| *A45F 3/00* | (2006.01) |

(52) U.S. Cl.

CPC ..... *A45F 3/047* (2013.01); *A45F 3/04* (2013.01); *A45F 3/06* (2013.01); *A45F 2003/003* (2013.01)

(58) Field of Classification Search

CPC .... A45F 3/04; A45F 3/06; A45F 3/042; A45F 3/047; A45F 3/08; A45F 2003/002; A45F 2003/006; A45F 2003/007; A45F 2003/008; A45F 2003/0045; A45F 2003/003

USPC ..... 224/583, 153, 627–659, 576, 577, 155; D3/244; 383/71, 72, 75, 76, 61.4, 92, 5

See application file for complete search history.

(56) References Cited

U.S. PATENT DOCUMENTS

| | | | | |
|---|---|---|---|---|
| 2,407,787 A | | 9/1946 | Kernahan | |
| 2,428,795 A | | 10/1947 | Frazee | |
| 2,834,970 A | * | 5/1958 | Nappe | A47C 27/122 5/420 |
| 3,121,884 A | * | 2/1964 | Emery | A47C 1/146 5/634 |
| 4,096,978 A | | 6/1978 | Noice | |
| 4,375,111 A | | 3/1983 | Hall | |
| 4,648,121 A | | 3/1987 | Lowe | |
| 4,884,731 A | * | 12/1989 | Sibley | A45F 3/04 224/651 |

(Continued)

*Primary Examiner* — Justin M Larson

(74) *Attorney, Agent, or Firm* — Liang & Hennessey LLP; Stanley D. Liang

(57) ABSTRACT

A backpack that comprises a series of durable fabric panels that have been sewn together to form a soft and expandable container, which has been equipped with ergonomic shoulder straps and numerous features for the homeless individual that help overcome many of the shortcomings and disadvantages of prior art. The backpack employs a series of adjustable quick-release straps to provide expandability and Velcro connections for detachability. The backpack employs an internal pleated back pad that is removable to be used as a sleeping pad and in combination with a chevron stitch pattern for added support and user comfort. The backpack also has a closure system for closing the top inner liner of a backpack.

1 Claim, 7 Drawing Sheets

(56) References Cited

U.S. PATENT DOCUMENTS 4,955,665 A * 9/1990 Richer ..... A47C 4/52 297/4
5,004,134 A 4/1991 Barry
5,012,964 A 5/1991 Falletta
5,066,001 A * 11/1991 Wilkinson ..... A63B 21/4037 482/52
5,265,292 A * 11/1993 Underell ..... A47C 4/52 297/380
5,384,923 A * 1/1995 Hwang ..... A47C 1/143 5/419
5,573,166 A * 11/1996 Leja ..... A45F 3/04 224/630
5,649,658 A 7/1997 Hoffman
5,669,089 A * 9/1997 Dees ..... B25H 5/00 5/417
5,676,293 A 10/1997 Farris
5,785,219 A 7/1998 Kraft
5,909,802 A 6/1999 Puco
5,961,017 A 10/1999 Mehler
6,015,072 A * 1/2000 Young ..... A45C 7/0063 190/103
6,024,265 A 2/2000 Clements
6,029,877 A 2/2000 Woods
6,161,739 A * 12/2000 Bentzen ..... A45F 3/08 224/153
6,186,380 B1 * 2/2001 Grounds ..... A45F 4/06 190/2
6,210,037 B1 * 4/2001 Brandon, Jr. ..... A45C 13/02 220/495.08
D449,947 S * 11/2001 Schoefer ..... D6/368
6,336,577 B1 * 1/2002 Harris ..... A45C 3/001 224/153
6,493,891 B1 12/2002 Livingston
6,655,565 B2 * 12/2003 Godshaw ..... A45F 3/04 224/576
6,742,635 B2 6/2004 Hirshberg
6,754,920 B2 * 6/2004 Fleming ..... A47C 27/001 5/420
7,222,705 B1 5/2007 Guza
D553,356 S 10/2007 Frago
7,374,071 B2 5/2008 Lavelle
8,079,502 B2 12/2011 Montgomery
8,251,269 B2 8/2012 Winneur
8,556,139 B2 10/2013 Almoumen
8,622,263 B2 1/2014 Su
8,714,425 B2 5/2014 Meyer
8,870,045 B1 10/2014 Aguirre
9,101,199 B1 8/2015 Harry
9,144,290 B1 9/2015 Hall
9,596,913 B2 * 3/2017 Thompson ..... A45F 3/04
10,492,592 B2 12/2019 Arroyo
10,667,600 B2 6/2020 Ji
D904,010 S * 12/2020 Wright ..... D3/217
10,952,522 B2 * 3/2021 D'Alessandro ..... A45F 3/04
2002/0038811 A1 4/2002 Vigny
2003/0024960 A1 * 2/2003 Greenstein ..... A45F 3/047 224/153
2005/0077329 A1 4/2005 Sconzo
2007/0017942 A1 1/2007 Hubbell
2008/0118671 A1 * 5/2008 Bienkiewicz ..... A47G 9/062 428/12
2009/0266860 A1 * 10/2009 Schneider Barterian ..... A45C 3/001 224/581
2010/0084443 A1 * 4/2010 Adelman ..... A45C 7/0059 224/153
2011/0186611 A1 8/2011 Eberle
2012/0006865 A1 1/2012 Su
2013/0001262 A1 1/2013 Razavi
2013/0015217 A1 * 1/2013 Perez ..... A45F 3/04 224/156
2013/0228600 A1 9/2013 Teixeira
2013/0240590 A1 * 9/2013 Montgomery ..... A45F 3/08 224/636
2014/0091007 A1 4/2014 Garside
2014/0101848 A1 * 4/2014 Murphy ..... A47G 9/08 5/420
2014/0231471 A1 * 8/2014 Thomas ..... A45C 13/103 224/153
2018/0235352 A1 * 8/2018 Jones ..... A45F 4/04
2019/0021475 A1 * 1/2019 Lindenmeyer ..... A45F 4/08
2019/0254400 A1 * 8/2019 Challa ..... A45C 13/103
2020/0128943 A1 4/2020 D'Alessandro
2021/0068512 A1 * 3/2021 Godshaw ..... A45C 1/02
2021/0145188 A1 * 5/2021 Thatcher ..... A45F 3/04

* cited by examiner

VETERAN SUPPORT BACKPACK

TECHNICAL FIELD

This disclosure relates to a support device for homeless war veterans ("veterans"). Specifically, the disclosure relates to a portable storage device (a backpack), to have, hold, and secure personal clothing, belongings and health support supplies, etc., for those who have been temporarily displaced from a personal residence.

BACKGROUND

It is an unfortunate but all too common occurrence to have an individual or family be displaced from their home or domicile and become "homeless." When this occurs the individual or family is forced to carry their clothing and personal care items in a mobile storage device. For a displaced veteran the preferred portable storage device is a backpack, which her/him training has taught him/her to utilize for carrying their belongings and life sustaining supplies. There are numerous backpacks available, but few have been constructed with features that are tailored to the homeless. This can be problematic when required to carry all their belongings in a bag that rests against their back with all the weight tethered by straps over their shoulders for long periods of time. Furthermore, the organization formed by the inventor seeks to provide these backpacks loaded with life sustaining supplies free of charge to the displaced veteran, which requires that the backpacks be produced economically.

Prior art backpacks are of numerous shapes and sizes with specialized features for specific tasks, but they are not dedicated to the homeless and most are very costly.

Accordingly, there exists a need for a backpack that is tailored for the homeless individual's needs that is functional, durable and affordable, especially for homeless veterans.

SUMMARY

This disclosure provides a backpack comprising a series of durable fabric panels that have been sewn together to form a soft and expandable container, the backpack been equipped with ergonomic shoulder straps and numerous features for the homeless individual that help overcome many of the shortcomings and disadvantages of the prior art backpacks. The disclosed backpack employs a series of adjustable quick-release straps to provide expandability and Velcro connections for detachability. The disclosed backpack employs an internal pleated back pad that is removable to be used as a sleeping pad and in combination with a chevron stitch pattern for added support and user comfort. The disclosed backpack also has a closure system for closing the top inner liner of a backpack. In some embodiments the disclosed backpack also includes a securable aircraft carrier cable to aid in temporarily securing the backpack when not in use. In some embodiments the disclosed backpack further comprises a belt loop, added to the lower reinforced section on the backside of the backpack, allowing the user to use any kind of belt to slide through the loop, providing additional back support when the user is wearing the backpack. In further embodiments, Velcro fabric may be attached to the inside of the belt loop, which Velcro fabric is commonly found on hiking belts, allowing the user to secure the belt into place once fed through the loop.

Numerous other aspects are provided in accordance with these and other aspects of the invention. Other features and aspects of the present invention will become more fully apparent from the following detailed description and the appended claims.

BRIEF DESCRIPTION OF THE DRAWINGS

The present disclosure can be better explained with reference to the drawings, in which the same reference numerals denote the same elements throughout, wherein.

Figure 1:
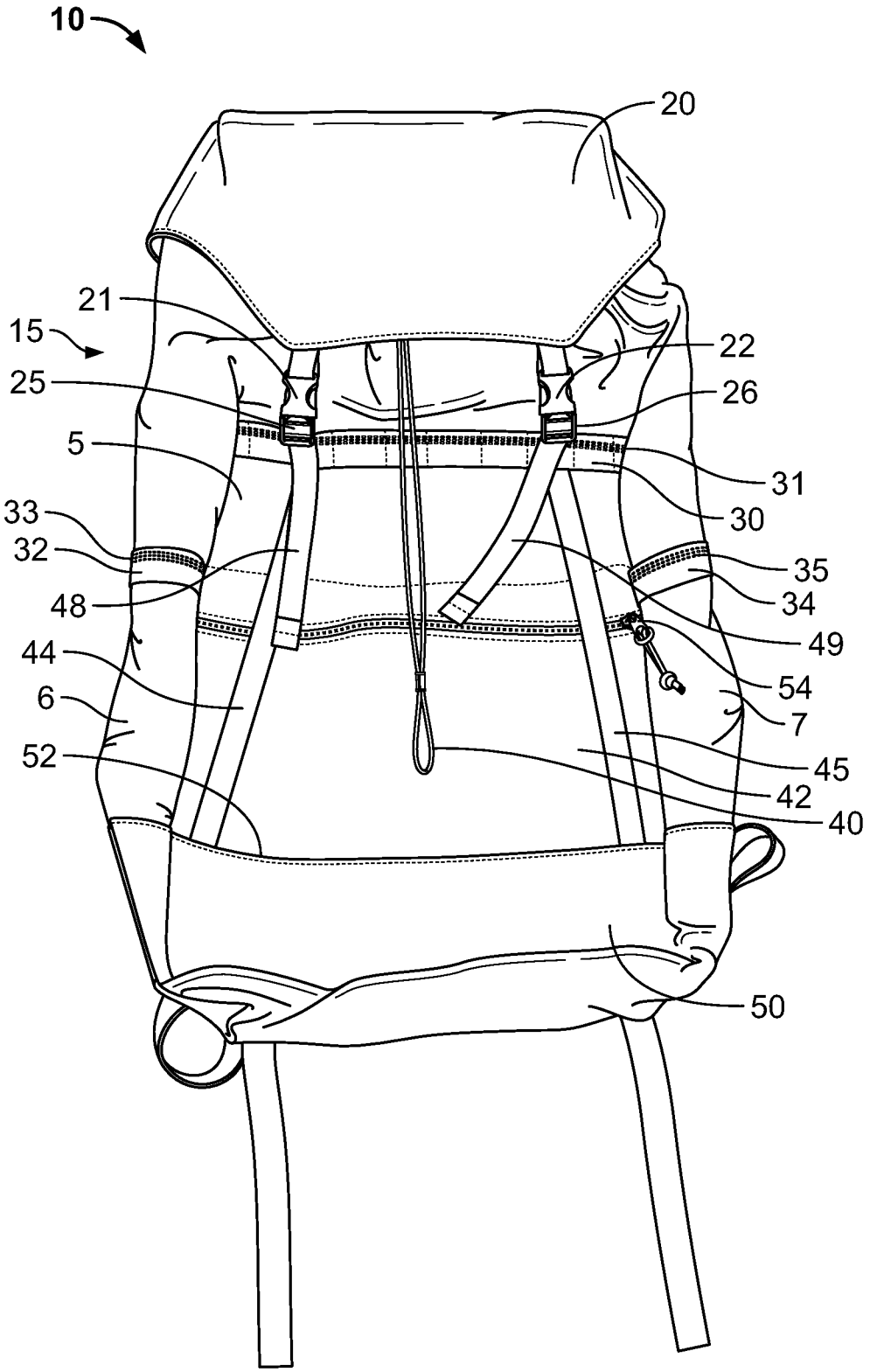
FIG. 1 is a front view of an exemplary backpack of the invention, with the detachable top attached to the backpack base.

The drawings present the disclosure by way of representation and not limitation. Numerous other modifications and embodiments can be devised by one skilled in the art which fall within the scope and spirit of the principals of this invention. The figures are idealized, are not drawn to scale, and are intended merely for illustrative purposes.

DETAILED DESCRIPTION

As used herein, the word "a" or "plurality" before a noun represents one or more of the particular noun.

For the terms "for example" and "such as," and grammatical equivalences thereof, the phrase "and without limitation" is understood to follow unless explicitly stated otherwise. As used herein, the term "about" is meant to account for variations due to experimental error. All measurements reported herein are understood to be modified by the term "about," whether or not the term is explicitly used, unless explicitly stated otherwise. As used herein, the singular forms "a," "an," and "the" include plural referents unless the context clearly dictates otherwise.

Unless otherwise defined, all technical and scientific terms used herein have the same meaning as commonly understood by one of ordinary skill in the art to which this invention belongs. Methods and materials are described herein for use in the present invention; other, suitable methods and materials known in the art can also be used. The materials and methods are illustrative only and not intended to be limiting. All publications, patent applications, patents, sequences, database entries, and other references mentioned herein are incorporated by reference in their entirety. In case of conflict, the present specification, including definitions, will control.

This disclosure provides a backpack comprising a series of durable fabric panels that have been sewn together to form a soft and expandable container, the backpack been equipped with ergonomic shoulder straps and numerous features for the homeless individual that help overcome many of the shortcomings and disadvantages of the prior art backpacks. The disclosed backpack employs a series of adjustable quick-release straps to provide expandability and Velcro connections for detachability. The disclosed backpack employs an internal pleated back pad that is removable to be used as a sleeping pad and in combination with a chevron stitch pattern for added support and user comfort. The disclosed backpack also has a closure system for closing the top inner liner of a backpack. In some embodiments the disclosed backpack also includes a securable aircraft carrier cable or lanyard to aid in temporarily securing the backpack when not in use. In some embodiments the disclosed backpack further comprises a belt loop, added to the lower reinforced section on the backside of the backpack, allowing the user to use any kind of belt (the belt is not a part of the backpack) to slide through the loop, providing additional back support when the user is wearing the backpack. In further embodiments, Velcro fabric may be attached to the inside of the belt loop, which Velcro fabric is commonly found on hiking belts, allowing the user to secure the belt into place once fed through the loop.

This disclosure provides a backpack comprising:

a backpack base comprising a front panel, a back panel, a left side panel, a right side panel and a bottom, a front loop-strap attached to the front panel, a left loop-strap attached to the left panel, a right loop strap attached to the right panel, two front straps attached to the bottom at one end of each front strap with a strap clip connected to the other end of each front strap, a Velcro strip attached to side of the front panel opposite the bottom, two shoulder straps attached to the back panel; and a detachable top having a front end and a back end, with a Velcro connector on an inner surface at the back end detachably connected to the Velcro strip attached to the side of the front panel, and with two quick release connectors at the front end, wherein each quick-release connector connects to one of the front strap clips, and a zipper connecting to a compartment in the detachable top.

In some embodiments, the backpack further comprises: an inner lining attached to a top end of the first panel, the second panel, the front panel, and the back panel, comprising an extended neck with at least four grommets attached to the surface of the extended neck with an opening in each grommet extending therethrough, and a hole; a draw-string securable lanyard or an aircraft carrier cable with a cinching end contained in the inner lining and a securing end emerging from the hole in the inner lining; and a duffle bag keeper, wherein the opening in each grommet is adapted to fit over the duffle bag keeper. In certain embodiments, the backpack further comprises a belt loop on the backside of the bottom of the backpack base, wherein, in some further embodiments, Velcro fabric is attached to the inside of the belt loop.

This disclosure further provides a closure system for a backpack comprising: an inner lining comprising an extended neck with at least four grommets attached to the surface of the extended neck with an opening in each grommet extending therethrough, and a hole; a draw-string securable lanyard or an aircraft carrier cable with a cinching end contained in the inner lining and a securing end emerging from the hole in the inner lining; and a duffle bag keeper, wherein the opening in each grommet is adapted to fit over the duffle bag keeper.

This disclosure also provides a backpack system comprising: a backpack base with an inner liner containing a pocket/sleeve; and a removable pleated back pad contained therein.

The draw-string securable lanyard or an aircraft carrier cable is made of a strong, resilient flexible material, such as stainless or carbon steel wire rope, woven carbon fiber, or paracord. In certain embodiments, the draw-string securable lanyard or aircraft carrier cable is made of aircraft carrier cable, a material that cannot be cut easily and can withstand exposure to water. Aircraft carrier cable is a type of coated, non-coated, stainless steel or galvanized wire rope. In some embodiments, the aircraft carrier cable is coated aircraft carrier cable.

In some embodiments, a belt loop is added to the bottom of the backpack base, a lower reinforced section, on the backside of the backpack. The belt loop allows for the user to use a belt (not shown, and is external and not part of the backpack) to slide through the loop, providing additional back support when the user is wearing the backpack. In some embodiments, attached to the inside of the belt loop is a piece of Velcro fabric, which is commonly found on hiking belts, allowing the user to secure the belt into place once fed through the loop. In certain embodiments, the belt loop extend through half or more of the length of the bottom of the backside of the backpack base. In other embodiments, several belt loops are present, each of which small and the belt is meant to slide through most or all of the belt loops.

A method of aiding a homeless war veteran is provided, comprising providing a disclosed backpack to said war veteran. Also disclosed is a method for aiding any homeless person, comprising providing a disclosed backpack to said person.

The disclosed backpack is of any suitable size and is made of any suitable material. Each component of the disclosed backpack may be made of any suitable material and be of any size. The backpack may be of any color or combination of colors. The disclosed backpack is made by methods known in the art.

These and other embodiments of the invention are described below with reference to the drawings.

FIG. 1 is a front prospective profile view showing the front, top, and bottom of backpack 10, an embodiment of the disclosed backpack. Backpack 10 includes a detachable top 20, which includes an internal compartment (not shown in this view), which can be used as a toiletry kit, and a backpack base 15. The detachable top 20 has quick release connectors 21 and 22 attached thereto, shown connected to strap clips 25 and 26, respectively. The backpack also includes a front loop-strap 30 with reflective tape 31 woven through attached to a front panel 5, left loop strap 32 with reflective tape 33 woven through attached to a left panel 6, and right loop strap 34, with reflective tape 35 woven through attached to a right panel 7, to which auxiliary devices can be attached or hung. The front panel 5, left panel 6, right panel 7 and back panel (not shown in this view) may be made of any suitable materials, in some embodiments, are made of a durable material, and in some further embodiments a water resistant material, such as ballistic nylon. One end of a draw-string securable aircraft carrier cable 40 is shown extending out from under the detachable top 20. The other end of the draw-string securable aircraft carrier cable 40, hidden from view in this figure, extends into and around an inner liner (also not seen in this view), where it can be used to cinch the inner liner. The draw-string securable aircraft carrier cable 40 can also be used to secure the backpack to any fixed object, such as a tree trunk or park bench. In some embodiments, the draw-string securable aircraft carrier cable 40. The backpack 10 also includes a front pouch 42; adjustable front quick-release straps 44 and 45 that hold down the top and to hold externally held devices, like a blanket; and a bottom 50 of durable fabric. The quick-release straps 44 and 45 are attached to bottom stitching 52, passed under front loop-strap 30 and looped through clips 25 and 26. One can pull on ends 48 and 49 of quick-release straps 44 and 45 to tighten the straps, when connected to quick-release connectors 21 and 22, as shown. Zipper 54 is used to open access to front pouch 42.

In some embodiments, a belt loop is added to the bottom 50, a lower reinforced section, on the backside of the backpack. The belt loop allows for the user to use a belt (not shown, and is external and not part of the backpack) to slide through the loop, providing additional back support when the user is wearing the backpack. In some embodiments, attached to the inside of the belt loop is a piece of Velcro fabric, which is commonly found on hiking belts, allowing the user to secure the belt into place once fed through the loop. In certain embodiments, the belt loop extend through half or more of the length of the bottom of the backside of the backpack base. In other embodiments, several belt loops are present, each of which small and the belt is meant to slide through most or all of the belt loops.

Figure 2:
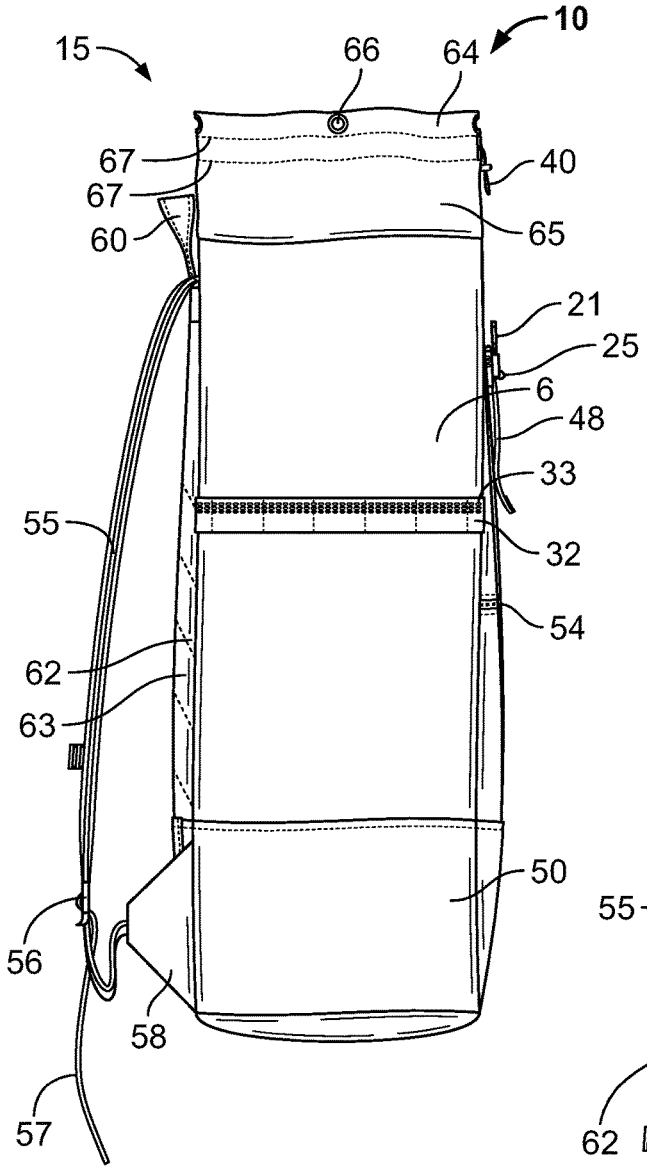
FIG. 2 is a side view of the backpack base of FIG. 1 with open extended inner liner.
Figure 8A:
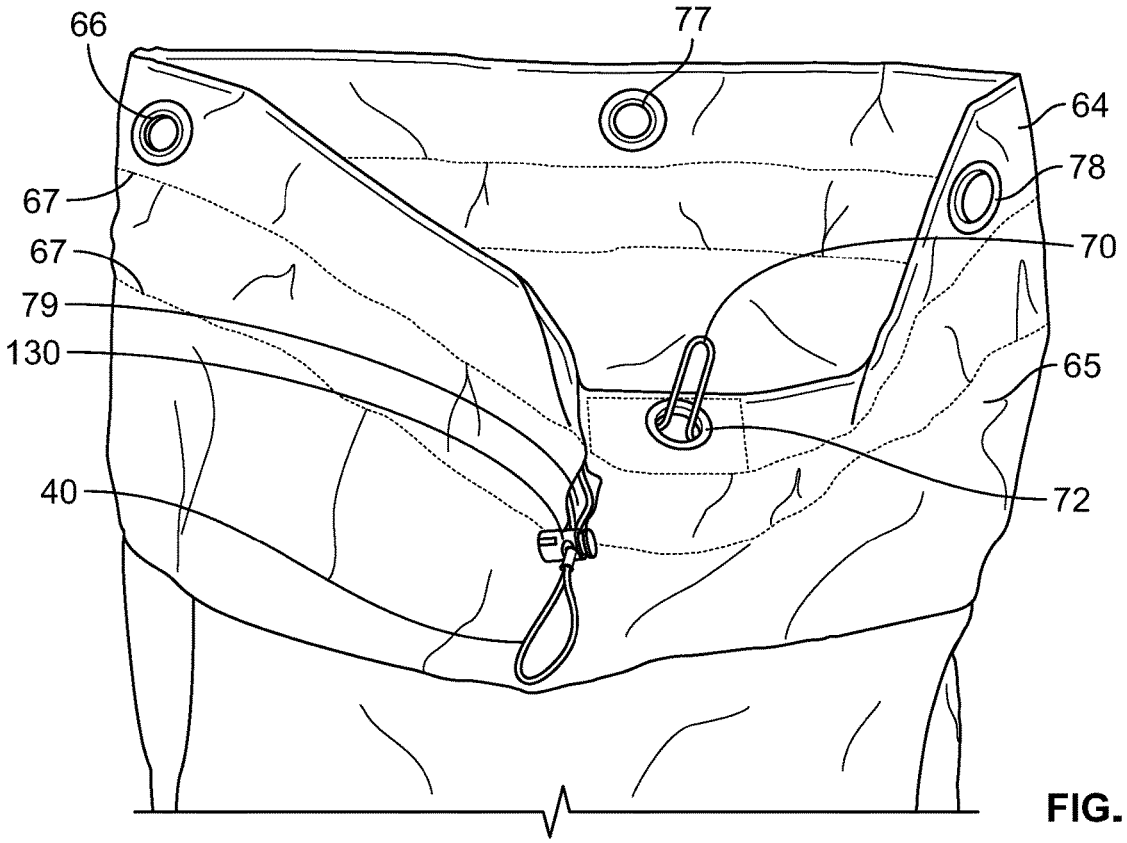
FIG. 8A is a detailed view of an exemplary backpack liner closure system in open configuration.
Figure 8B:
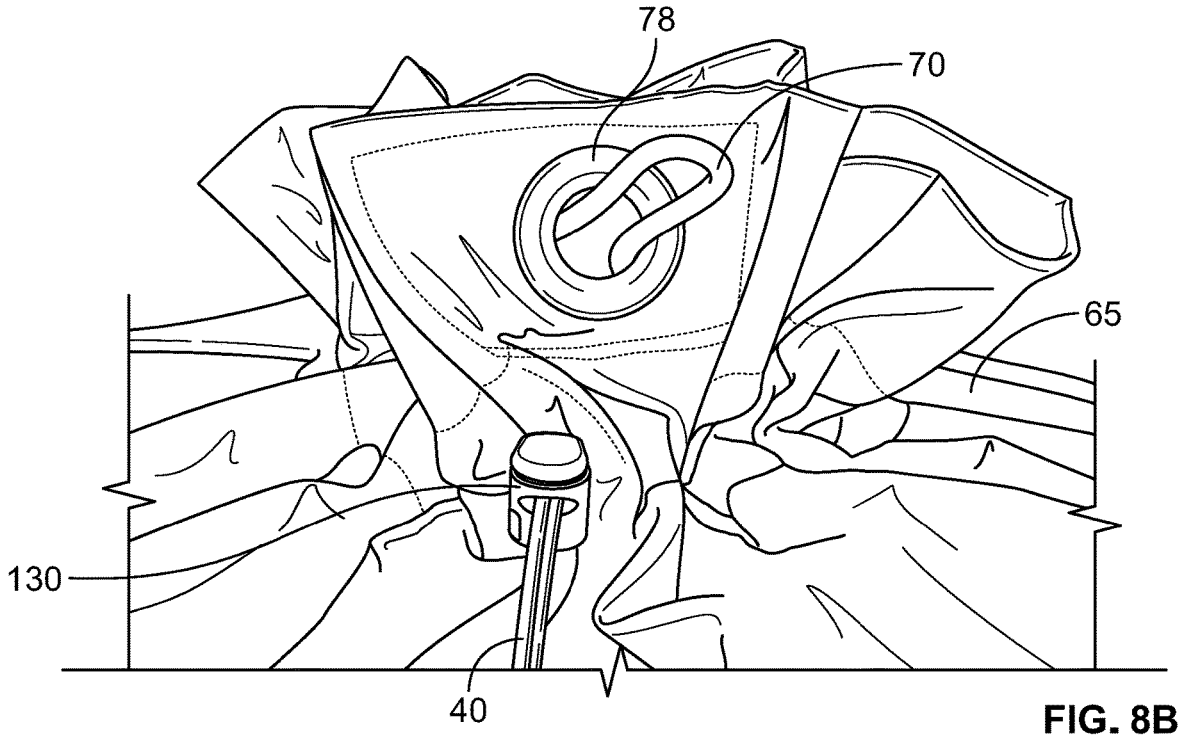
FIG. 8B is a detailed view of the liner closure system of FIG. 8A in secured/closed configuration.

FIG. 2 is a side profile view showing the top, bottom, and left side of the backpack base 15. Attached to the left panel 6 is a left loop-strap 32 with reflective tape 33 woven through, to which auxiliary devices can be attached or hung. Shown are strap clip 25, the left edge of zipper 54, draw-string securable aircraft carrier cable 40 used to cinch the inner liner and/or to secure the device to any fixed object, and bottom 50. In this view, shown are an ergonomic left shoulder strap 55, which is connected to a left adjustable shoulder strap connector 56; a left bottom strap 57 looped through strap connector 56 at one end and attached to a left side flap 58 at the other end. Back panel 63 is stitched to a support material (hidden from view), such as a panel of cell foam, by chevron reinforcement stitching 62. The chevron reinforcement stitching 62 provides stability in back panel 63. In this view, the detachable top 20 has been removed and is not shown. A rear handle 60 is included for carrying the device by hand. Shown are extended neck 64 of the inner liner 65, which is shown in a fully opened condition, with left grommet 66 and stitch lines 67. The function of the stich lines 67, left grommet 66, and draw-string securable aircraft carrier cable in closure of the extended neck 64 is shown in FIG. 8A and FIG. 8B and described in detail below. In certain embodiments, the inner liner 65 is made of a flexible tear resistant material, such as ripstop nylon. In some embodiments, not shown in the drawings, the inner liner 65 lines the entire inner surface of the backpack base 15, adding to the durability of the backpack. Also shown are quick-release connector 21 and end 48.

Figure 3:
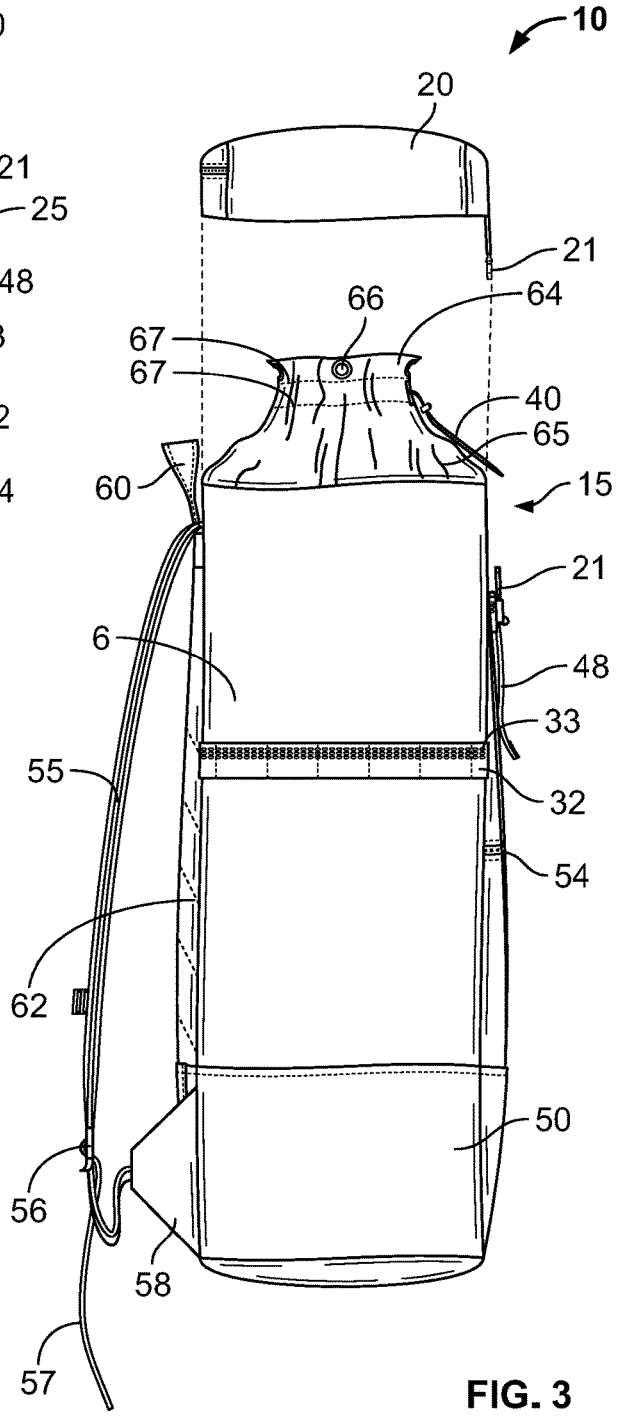
FIG. 3 is a side view of the backpack of FIG. 1 with closed inner liner and the detachable top removed from the backpack base.

FIG. 3 is a side profile view showing the top, bottom, and left side of the backpack 10. Detachable top 20, which can be used as a toiletry kit has been removed from the backpack base 15 in this view, and extended neck 64 of the inner liner 65 is shown partially closed. Other components shown in FIG. 2 are also shown in FIG. 3, base 15, quick-release connector 21, left panel 6 with left loop-strap 32 with reflective tape 33 woven through to which auxiliary devices can be attached or hung; zipper 54, end 48; draw-string securable aircraft carrier cable 40 used to cinch the inner liner and/or to secure the device to any fixed object; bottom 50 of durable fabric material; left shoulder strap 55; strap connector 56, left bottom strap 57, left side flap 58, left grommet 66, stitch lines 67, and chevron reinforcement stitching 62. A rear handle 60 is included for carrying the device by hand.

Figure 4A:
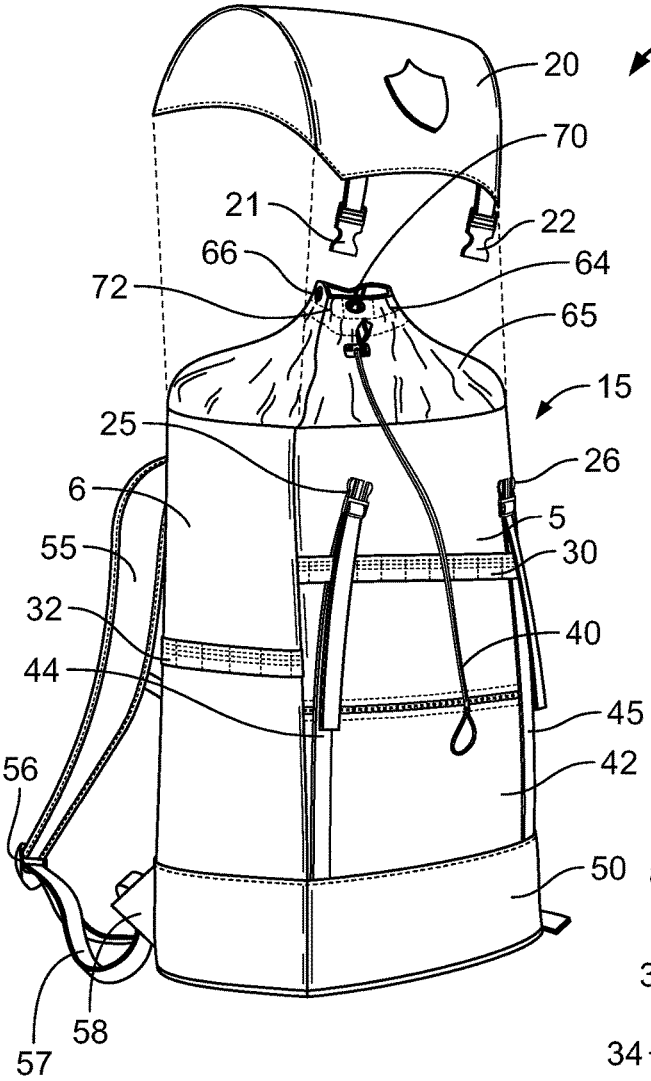
FIG. 4A is a front perspective view of the backpack base and detachable top of FIG. 3.

FIG. 4A is a front profile view showing the left side and the lid closure backpack 10. It shows detachable top 20, which can be used as a toiletry kit, with quick-release connectors 21 and 22 removed from backpack base 15. Shown are the front quick-release straps 44 and 45 attached to strap clips 25 and 26, left panel 6, front panel 5, front loop-strap 30 and left loop-strap 32 with reflective tape woven through to which auxiliary devices can be attached or hung, draw-string securable aircraft carrier cable 40 used to cinch the inner liner and/or to secure the device to any fixed object; front pouch 42; bottom 50 of durable fabric material, left ergonomic shoulder strap 55, strap connector 56, left bottom strap 57, and left side flap 58. The extended neck 64 of inner liner 65 is in a closed conformation in this view, and duffle bag keeper 70 can be seen extending out through front grommet 72. Front quick-release straps 44 and 45 are adjustable and can hold down the top, when attached thereto, as well as hold externally held devices, like a blanket. Also shown is left grommet 66.

Figure 4B:
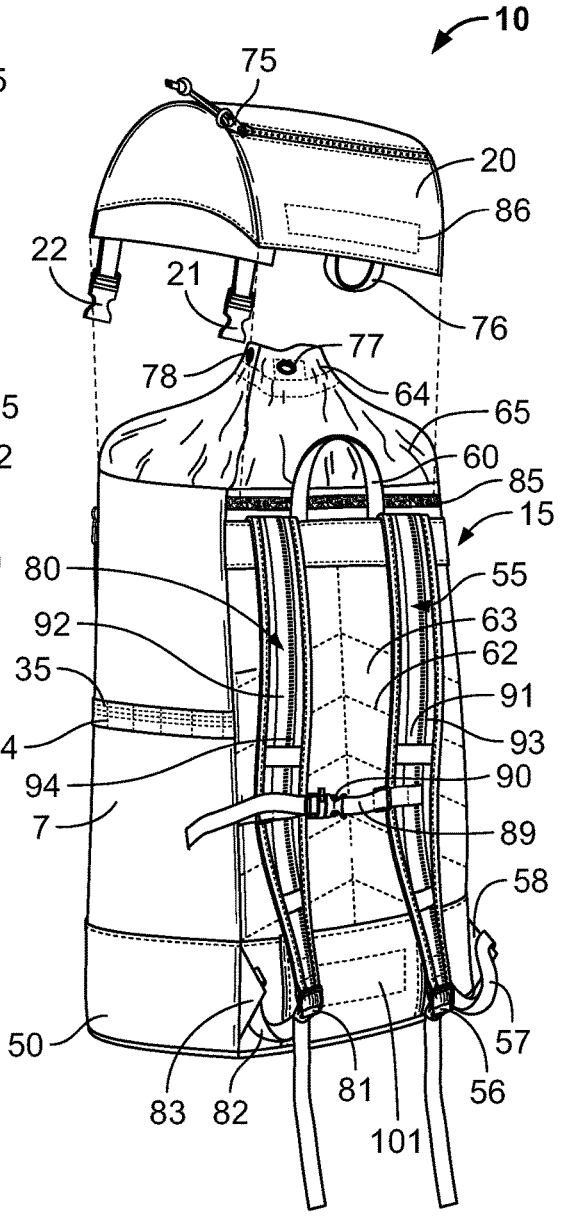
FIG. 4B is a rear perspective view of the backpack base and detachable top of FIG. 3.

FIG. 4B is a back profile view showing the right side, back and the top of backpack 10 with the detachable top 20 removed from the backpack base 15. It shows detachable top 20, which can be used as a toiletry kit; with quick-release connectors 21 and 22, a carrying loop 76, and a zipper 75, which opens a compartment in the detachable top 20. One can also see right loop-strap 34 with reflective tape 35 woven through to which auxiliary devices can be attached or hung attached to right panel 7; bottom 50 of durable fabric material; left ergonomic shoulder strap 55; adjustable left strap connector 56; left bottom strap 57; left side flap 58; right ergonomic shoulder strap 80; adjustable right strap connector 81; right bottom strap 82; right side flap 83; the rear handle 60 for carrying the device by hand; the chevron reinforcement stitching 62 in back panel 63 to provide stability in the back panel. Inner liner 65 is shown with partially closed extended neck 64, rear grommet 77 and right grommet 78. Shown are a Velcro strip 85 which is an attachment point for the removable top 20, and stitching 86 on the surface of the removable top 20 that attaches a corresponding Velcro strip to the inside of the removable top. One can also see an adjustable chest strap connection 89 between the shoulder straps which has a whistle 95 built into the quick release buckle 90, and accent straps 91 and 92 with reflective tape 93 and 94 woven through attached to the left ergonomic shoulder strap 55 and right ergonomic shoulder strap 80, respectively. Shown also is belt loop 101, which is placed on bottom 50.

Figure 5:
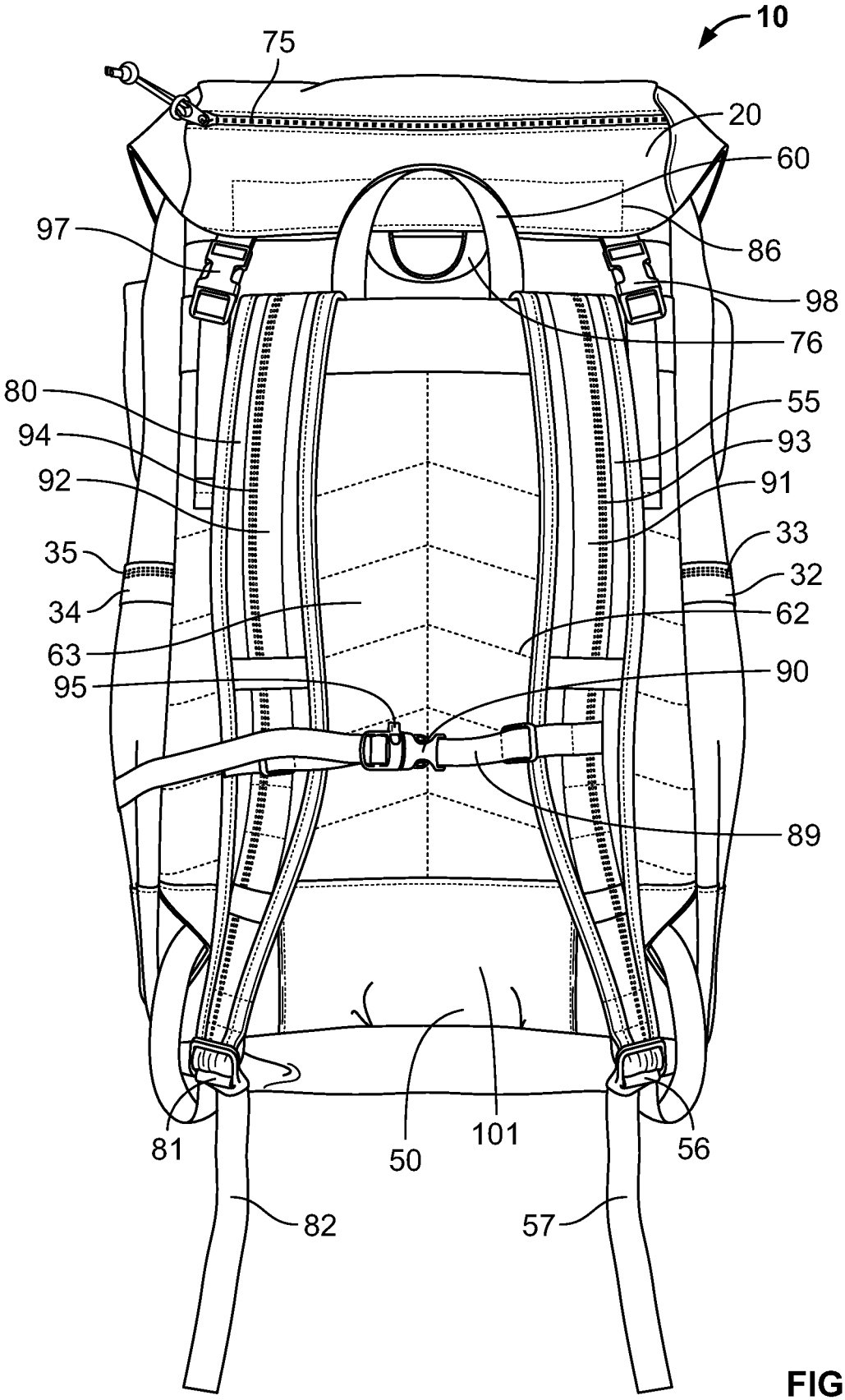
FIG. 5 is a rear view of the backpack of FIG. 1.

FIG. 5 is a rear prospective profile view showing the back, top, and bottom of backpack 10. It shows the detachable top 20, which can be used as a toiletry kit; right loop-strap 34 and left loop-strap 32 with reflective tape 33 and 35 woven through to which auxiliary devices can be attached or hung; the bottom 50 of durable fabric material; left ergonomic shoulder strap 55; right ergonomic shoulder strap 80; left shoulder strap connector 56; right shoulder strap connector 81; left bottom strap 57; right bottom strap 82; rear handle 60 for carrying the backpack by hand; chevron reinforcement stitching 62 to provide stability in the back panel 63; stitching 86 on the detachable top 20 that attaches a Velcro connector on the inner surface of the detachable top 20 and serves as an attachment point; optional quick release buckles 97 and 98 to further secure the detachable top; carrying loop 76 to carry and hang the detachable top; zipper 75 to the pouch of the detachable top 20; the adjustable chest strap connection 89 between the shoulder straps which has a whistle 95 built into the quick release buckle 90; and accent straps 91 and 92 with reflective tape 93 and 94 woven through. Shown also is belt loop 101, which is placed on bottom 50.

Figure 6A:
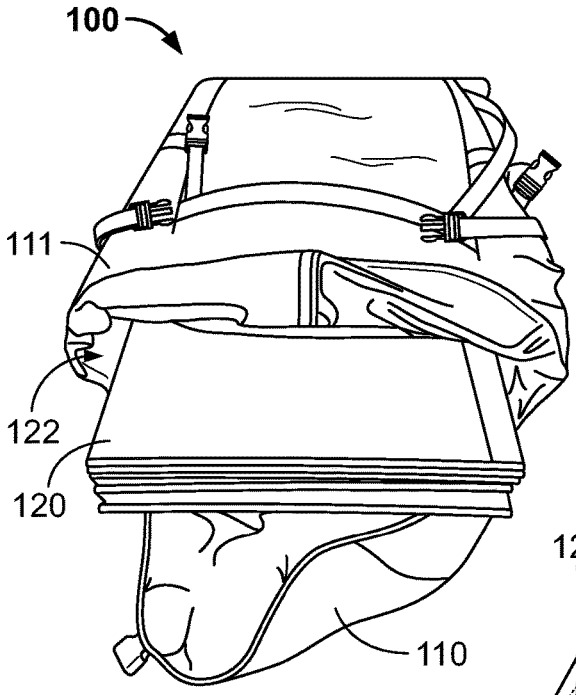
FIG. 6A is a top perspective view of an exemplary backpack system of the invention, with a liner and top open to show a pleated back pad partially inserted into a pocket/sleeve.

FIG. 6A is a top perspective view of part of an exemplary backpack system of the invention showing a backpack base 100 with top 110 and the inner liner 111 open and a pleated back pad 120 partially inserted into a pocket/sleeve 122. The pocket/sleeve 122 is attached to the sides of the back panel of the backpack base (not shown in this view), and is adapted to fit the folded pleated back pad 120, thereby providing structural support to the backpack base when inserted therein. In this view an extended neck of the inner liner 111 is turned under and hidden from view. The pleated back pad 120 has an alternate use as a sleeping mat or seat.

Figure 6B:
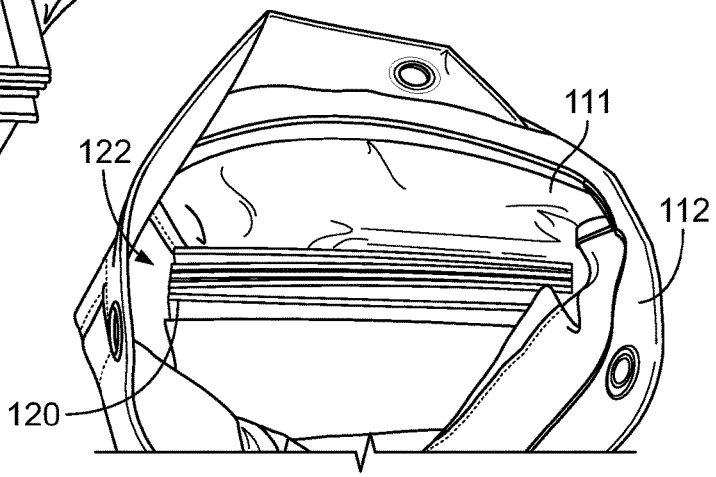
FIG. 6B is a top perspective detailed view of the pocket/sleeve of the backpack system of FIG. 6A with the pleated back pad fully inserted therein.

FIG. 6B is a top perspective detailed partial view of the top part of the backpack system of FIG. 6A, with the extended neck 112 of the inner liner 111 fully open to show the inner surface of the inner liner 111 and pocket/sleeve 122 with the pleated back pad 120 fully inserted therein.

Figure 6C:
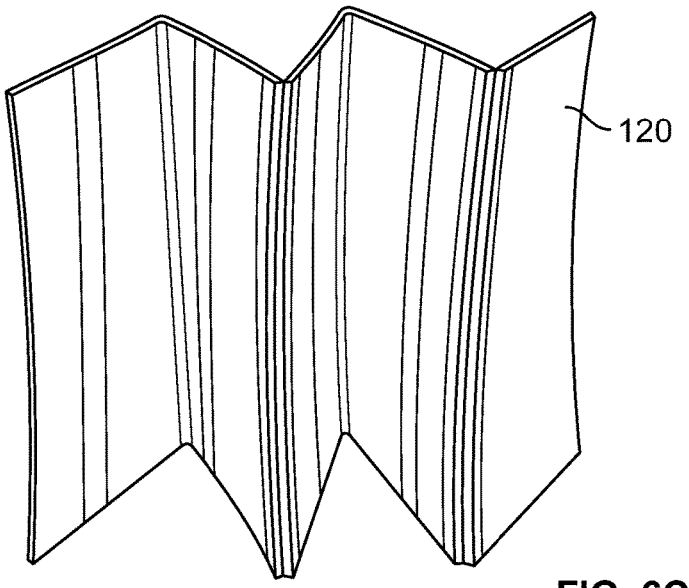
FIG. 6C is a side view of a partially unfolded pleated back pad of the backpack system of FIG. 6A and FIG. 6B.

FIG. 6C is a side view of the pleated back pad 120 of the system illustrated in FIG. 6A and FIG. 6B partially unfolded.

Figure 7:
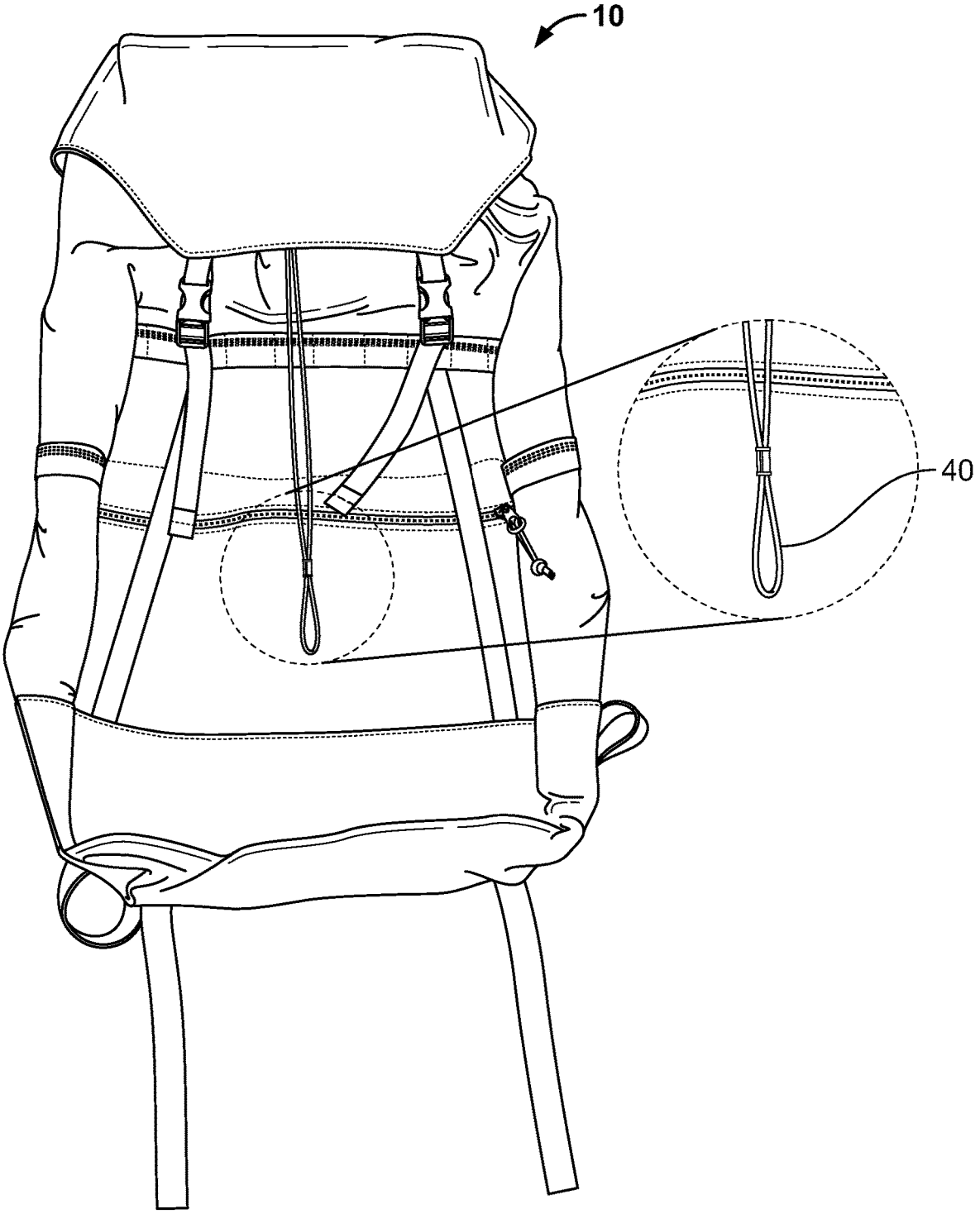
FIG. 7 is a view of the backpack of FIG. 1 with a detailed view of the securable lanyard/locking mechanism.

FIG. 7 is a view of backpack 10, as shown and described in FIG. 1, above, with a detailed view of the end loop of draw-string securable aircraft carrier cable 40. of that can be used to hold the inner liner closed and/or to secure the device. The drawstring securable aircraft carrier cable 40 can be used to hold the inner liner closed and/or to secure the backpack by wrapping it around and attaching it to a fixed object.

FIG. 8A is a detailed enlarged view of a seabag closure the at the top backpack base 15 shown in FIG. 2, FIG. 3, FIG. 4A, and FIG. 4B, above, illustrating the securable aircraft carrier cable 40 and locking mechanism. It shows the drawstring securable aircraft carrier cable 40 used to cinch the extended neck 64 of inner liner 65 and/or to secure the backpack to a fixed object; duffle bag keeper 70 which allows the aircraft carrier cable 40 to be locked to it; and left grommet 66, front grommet 72, back grommet 77, and right grommet 78, which affix to the duffle bag keeper 70 by being placed over the keeper to close off bag. One end of the drawstring securable aircraft carrier cable 40, hidden from view, is contained in the inner liner 65 between the two stitch lines 67 in the inner liner 65, which join two layers of inner liner 65 together at that point. The other end of the draw-string securable aircraft carrier cable 40 can be seen emerging from opening 79 in the front of inner liner 65. Cinch lock 130 on the drawstring securable lanyard 40 can be pinched to open the lock, slid up the lanyard toward the extended neck 64, and released to close the cinch lock as or after the grommets are placed over the duffle bag keeper 70, as shown in the next figure, below.

FIG. 8B is a detailed view of the seabag closure of FIG. 8A with all four grommets, only the top one of which, right grommet 78, is visible, gathered onto duffle bag keeper 70 and with cinch lock 130 at the top of the draw-string securable lanyard 40 adjacent to the gathered outer surface of inner liner 65. A padlock or other lock can be connected to duffle bag keeper 70 once the seabag closure has been closed, as shown in this figure, to secure the opening of the backpack. The drawstring securable lanyard 40 can also be looped around a fixed object, such as a park bench leg and the looped end of the lanyard, shown in detail in FIG. 7, can be locked to the duffle bag keeper 70 with the same padlock or other lock attached thereto to secure the opening of the backpack.

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the appended claims. Thus, while only certain features of the invention have been illustrated and described, many modifications and changes will occur to those skilled in the art. It is therefore to be understood that the appended claims are intended to cover all such modifications and changes as fall within the true spirit of the invention.

What is claimed is:

1. A backpack comprising:

a backpack base comprising a front panel, a back panel, a left side panel, a right side panel and a bottom, a front loop-strap attached to the front panel, a left loop-strap attached to the left panel, a right loop-strap attached to the right panel, two front straps attached to the bottom at one end of each front strap with a strap clip connected to the other end of each front strap, one of a hook and loop fastener strip attached to the back panel opposite the bottom, two shoulder straps attached to the back panel; and a detachable top having a front end and a back end, with the other of a hook and loop fastener strip on an inner surface at the back end detachably connected to the fastener strip attached to the back panel, and with two quick-release connectors at the front end, wherein each quick-release connector connects to one of the front strap clips, and a zipper connecting to a compartment in the detachable top; an inner liner containing a pocket/sleeve; and a removable pleated back pad contained in the pocket/sleeve.

* * * * *